US009351614B2

(12) United States Patent
Chen

(10) Patent No.: US 9,351,614 B2
(45) Date of Patent: May 31, 2016

(54) QUICK INSTALLATION HINGE SEAT OF CLOSETOOL COVER PLATE

(71) Applicant: HOTI (XIA-MEN) PLUMBING ING., Fujian (CN)

(72) Inventor: Guobin Chen, Xiamen (CH)

(73) Assignee: HOTI (XIAMEN) PLUMBING INC., Xiamen, Fujian (CN)

( * ) Notice: Subject to any disclaimer, the term of this patent is extended or adjusted under 35 U.S.C. 154(b) by 0 days.

(21) Appl. No.: 14/000,205

(22) PCT Filed: Dec. 3, 2012

(86) PCT No.: PCT/CN2012/085730
§ 371 (c)(1),
(2) Date: Aug. 16, 2013

(87) PCT Pub. No.: WO2014/032372
PCT Pub. Date: Mar. 6, 2014

(65) Prior Publication Data

US 2015/0216379 A1 Aug. 6, 2015

(30) Foreign Application Priority Data

Aug. 29, 2012 (CN) ..... 2012 1 0312014

(51) Int. Cl.
*A47K 13/12* (2006.01)

(52) U.S. Cl.
CPC ..... *A47K 13/12* (2013.01)

(58) Field of Classification Search
CPC ..... A47K 13/04; A47K 13/12; A47K 13/26; A47K 13/28
USPC ..... 16/257–259, 262, 267, 270, 392; 4/234, 4/236–237, 240, 242.1, 246.1–246.5, 253
See application file for complete search history.

(56) References Cited

U.S. PATENT DOCUMENTS 5,361,423 A * 11/1994 Notzold ..... A47K 13/26 4/237
8,327,471 B2 * 12/2012 Fielding, Jr. ..... A47K 13/26 4/236

FOREIGN PATENT DOCUMENTS

CN 201337385 * 11/2009 ..... A47K 13/26
CN 202288107 * 7/2012 ..... A47K 13/26

* cited by examiner

*Primary Examiner* — Paul R Durand
*Assistant Examiner* — Nicholas Ros

(57) ABSTRACT

A quick installation hinge seat of a closestool cover plate includes two hinge shafts and two support seats. Each hinge shaft has a pin hole for connection of a pin provided on each support seat. A button switch is mounted between the two hinge shafts to control the pin in the pin hole. The button switch includes a hinge pipe, a button seat, a lock control rod slidable in the radial direction of the hinge pipe, a spring, and a button to press the lock control rod. Two ends of the lock control rod are axially inserted in the two hinge shafts respectively and slideable radially. Each of the two ends of the lock control rod has a locking plate and an unlocking plate. The locking plate and the unlocking plate are arranged in a stagger manner. Each pin has a locking groove and an unlocking groove thereon.

1 Claim, 13 Drawing Sheets

QUICK INSTALLATION HINGE SEAT OF CLOSETOOL COVER PLATE

BACKGROUND OF THE INVENTION

1. Field of the Invention

The present invention relates to a connection device of a closestool cover plate, and more particular to a quick installation hinge seat of a closestool cover plate to be mounted and dismounted quickly.

2. Description of the Prior Art

Many conventional closestool cover plates adopt a single-button control connecting structure. For example, Chinese Patent Publication No. CN201303910Y disclosures a closestool cover plate with a keying quick installation device, which comprises an upper cover, a seat ring, a button-typed quick installation buckle switch and a cover plate supporter; wherein the bottom of the seat ring is provided with an integrally formed shaft sleeve; the middle part of the shaft sleeve is provided with a control chamber; two ends of the shaft sleeve are provided with buckle switches; the buckle switch is connected with the bottom end of the upper cover by the rotation shaft; the supporting shaft on the supporter is inserted with the buckle switch; two sides inside the control chamber are provided with an ejector rod respectively; the keystroke is linked with the two ejector rods; a panel is sheathed on the keystroke and is clamped in the control chamber; the shaft sleeve at the bottom of the seat ring of the cover plate is integrally formed so that the whole cover plate is more beautiful; the middle part of the shaft sleeve is provided with the control chamber; the spring is arranged between the ejector rods in the control chamber and the buckle switch; the keystroke is linked with the two ejector rods; when the keystroke is pressed, the keystroke extrudes the ejector rods to move towards the two sides so as to push against the button of the buckle switch at the two ends of the shaft sleeve of the seat ring, thus leading the buckle switch to be quickly connected with or separated from the supporting shaft, thereby completing quick assembly and disassembly of the cover plate. The dismounting structure of this cover plate is complicated. Besides, the exposed single button controls the ejector rod to press the buckle switch. It is necessary to overcome the elasticity of four springs. The single button can be operated conveniently, but it is more laborious to press the button. When one of the two button-typed buckle switches disposed at the two ends of the cover plate malfunctions, the cover plate is unable to dismount quickly so its reliability is low.

Chinese Patent Publication No. CN202223141U discloses a quick detachment assisting mechanism of a closestool cover plate. The quick detachment assisting mechanism of the closestool cover plate comprises two shaft sleeves, two rotating shafts, two button mechanisms and a keypress rod, wherein the shaft sleeves are installed on two sides of the bottom of the closestool cover plate and are used for installing the two rotating shafts; insertion holes are radially formed on the two rotating shafts; two inserted pins are arranged at corresponding positions of a closestool body; the inserted pins are inserted into the insertion holes of the rotating shafts to connect the rotating shafts and the inserted pins; the two button mechanisms are installed in the shaft sleeves and used for locking or unlocking the inserted pins which are inserted into the insertion holes of the rotating shafts; the keypress rod is provided with a keypress part for pressing; the quick detachment assisting mechanism of the closestool cover plate is characterized in that the button mechanisms are installed on circumferential surfaces of the rotating shafts and can move along radial directions of the rotating shafts; and two ends of the keypress rod are contacted and lean against the two button mechanisms and can push the button mechanisms to move radially. The existing problem of the quick detachment assisting mechanism of the closestool cover plate is that when one of the button mechanisms malfunctions, the whole quick detachment assisting mechanism will break down. Besides, each of the two button mechanisms is provided with a spring, and a spring is provided between the keypress rod and the accommodation chamber. When the keypress part is pressed each time, the keypress rod has to overcome the elasticity of three springs. It is important that the two ends of the keypress rod must overcome the spring force of the button mechanisms. Thus, it is more laborious to press the keypress part to operate the button mechanism to unlock the inserted pins.

Accordingly, the inventor of the present invention has devoted himself based on his many years of practical experiences to solve these problems.

SUMMARY OF THE INVENTION

The primary object of the present invention is to provide a quick installation hinge seat of a closestool cover plate to be mounted quickly and easily.

In order to achieve the aforesaid object, the present invention comprises two hinge shafts to be mounted in shaft sleeves at two sides of a rear end of the cover plate and two support seats for connecting with a closetool. The hinge shafts each have a radial pin hole for connection of a pin provided on each of the support seats. A button switch is provided between the two hinge shafts to control the pin to be in or out of the pin hole. The button switch comprises a hinge pipe having two ends connected to the two hinge shafts, a button seat fixed in a middle portion of the hinge pipe, a lock control rod which is axially inserted in the button seat and slidable in the button seat in a radial direction of the hinge pipe, a spring disposed between the button seat and the lock control rod, and a button mounted on the button seat and holding against the lock control rod. The button is exposed out of a button installation hole at the middle portion of the hinge pipe. Two ends of the lock control rod are axially inserted in the two hinge shafts respectively, and are slideable radially. Each of the two ends of the lock control rod has a locking plate and an unlocking plate. The locking plate and the unlocking plate are arranged in a staggered manner. The pin has an annular locking groove and an annular unlocking groove thereon. The locking plate is adapted to engage with the locking groove. The unlocking plate is adapted to disengage from the unlocking groove. A resilient trigger device is provided between the button seat and the button for the button to be self-locking in a pressed state. When the button is self-locking, the locking plate disengages from the locking groove and the unlocking plate engages with the unlocking groove.

Preferably, each of the two hinge shafts comprises a rotation damper and an anti-rotation shaft axially connected. The anti-rotation shaft is connected with the corresponding end of the hinge pipe. The radial pin hole is disposed in the anti-rotation shaft. The two ends of the lock control rod biased by the spring are axially inserted into the respective anti-rotation shafts of the two hinge shafts to slide radially. The two ends of the hinge pipe have openings corresponding in position to the radial pin holes of the anti-rotation shafts of the two hinge shafts. The pins of the two support seats pass through the openings and are inserted into the radial pin holes of the anti-rotation shafts.

Preferably, the anti-rotation shaft has an upper slide groove and a lower slide groove to communicate with the radial pin hole. The locking plate of the lock control rod is inserted in the upper slide groove. The unlocking plate of the lock control rod is inserted in the lower slide groove. The pin is located between the locking plate and the unlocking plate. The locking plate is located in the radial pin hole and engages with the locking groove of the pin. The unlocking plate is located out of the radial pin hole and disengages from the unlocking groove of the pin. The lock control rod is biased forward by the spring in a normal state, and the locking plate in the upper slide groove slides forward into the pin hole to engage with the locking groove of the pin. The unlocking plate in the lower slide groove slides forward to disengage from the pin hole radially. The button is pressed to press the lock control rod to compress the spring. The lock control rod in the upper slide groove slides rearward for the locking plate to disengage from the pin hole. The unlocking plate in the lower slide groove slides rearward into the pin hole to engage with the unlocking groove.

Preferably, the top end of the pin has an annular upper guide ramp above the locking groove to push the locking plate out of the radial pin hole when the pin is inserted into the pin hole. The upper wall of the unlocking groove has an annular lower guide ramp to push the unlocking plate out of the radial pin hole when the pin is pulled out of the pin hole. When the pin is inserted into the pin hole, the upper guide ramp at the top of the pin pushes the locking plate out of the pin hole. The locking plate moves the lock control rod rearward to compress the spring. When the locking plate in the upper slide groove is aligned with the locking groove of the pin, the lock control rod is biased by the spring to bring the locking plates at the two ends thereof in the upper slide grooves to slide forward into the pin holes for the locking plates to engage with the locking grooves of the pins so that the hinge shafts and the pins of the support seats are connected and fixed. The cover plate and the closestool are mounted and connected quickly.

Preferably, the lock control rod has a spring installation hole at a central portion thereof. The spring is mounted in the spring installation hole. Two ends of the spring holds against the button seat and the lock control rod. The button has a flange to mate with slide of the button seat. The lock control rod holds against the button. The button is exposed out of the hinge pipe. The flange of the button is located in the hinge pipe to engage with the edge of the button installation hole. The spring is first mounted in the spring installation hole and the spring is located at the inner rear wall of the button seat, and then the lock control rod is axially inserted in the button seat. The spring is located at the middle of the button seat. The button is mounted at the front end of the button seat, and then the button is pressed to bring the control lock rod to compress the spring so that the lock control rod, the button seat and the button are axially mounted in the hinge pipe. When the button is aligned with the central button installation hole of the hinge pipe, the button biased by the spring can be pressed to be in or out of the button installation hole. The flange of the button is located in the hinge pipe to engage with the edge of the button installation hole. The button is exposed out of the hinge pipe. The quick assembly of the button switch of the present invention is completed.

Preferably, the button comprises a guide rod which is composed of two resilient plates and deformable radially. Each resilient plate has a conical barb portion at a distal end thereof. The button seat has a circular hole for resilient connection of the guide rod. The guide rod and the circular hole constitute the resilient trigger device. When the guide rod is inserted in the circular hole and the barb portion engages with an end surface of the circular hole, the resilient trigger device forms a self-locking state relative to the button. When the guide rod disengages from the end surface of the circular hole, the resilient trigger device releases the self-locking state relative to the button and the button is reset. The guide rod of the button cooperates with the circular hole of the button seat to achieve a self-locking function of the button in a pressed state. When the pin is pulled out of the pin hole, the lower guide ramp of the pin presses the unlocking plate forward to bring the lock control rod and the button to move forward, such that the guide rod of the button disengages from the circular hole to achieve a return function.

Preferably, the locking plate has a first curved edge at a distal end thereof to engage with the locking groove of the pin, and the unlocking plate has a second curved edge at a distal end thereof to engage with the unlocking groove of the pin. The first and second curved edges at the distal ends of the locking plate and the unlocking plate form a radial enlarged opening for the unlocking plates and the locking plates at the ends of the lock control rod to have enough moving route when moving in the radial direction of the hinge pipe. It is not necessary to increase the staggered gap between the unlocking plate and the locking plate for the need of a small-sized hinge shaft.

Preferably, the first cured edge and the second curved edge each are a quarter-circular arc.

The lock control rod in the button switch can be moved forward and back in the hinge pipe. Each of the two ends of the lock control rod has a locking plate and an unlocking plate. The locking plate and the unlocking plate are arranged in a staggered manner. The button seat, the spring, the lock control rod and the button constitute a button switch having a self-locking function. When the pin is inserted into the pin hole, the pin pushes the locking plate out of the pin hole. The locking plate moves the lock control rod rearward to compress the spring. When the locking plate in the upper slide groove is aligned with the locking groove of the pin, the lock control rod is biased by the spring to bring the locking plates at the two ends thereof in the upper slide grooves to slide forward into the pin holes for the locking plates to engage with the locking grooves of the pins to achieve a locking function of the lock control rod relative to the pins. The button is pressed to bring the lock control rod to compress the spring and to move rearward. The two locking plates of the lock control rod slides rearward out of the pin holes of the hinge shafts for the locking plates to disengage from the locking grooves of the pins. The unlocking plates are engaged in the unlocking groves of the pins so that the pins can be pulled out. The guide rod of the button is pressed to insert into the circular hole of the button seat for the button being self-locking in a pressed state to achieve an unlocking function of the lock control rod relative to the pin. When the pin is pulled out of the pin hole, the unlocking groove of the pin presses the unlocking plate forward to bring the lock control rod and the button to move forward, such that the guide rod of the button disengages from the circular hole to achieve a return function by the spring.

Compared to the prior art, the present invention has the following advantages.

1. The pin inserted into the pin hole doesn't adopt the complicated spring switch lock buckle. It uses the locking plate and the unlocking plate at each end of the lock control rod to lock or unlock the pin. Besides, the lock control rod only uses a spring to return. Thus, the force to press the lock control rod through the button is less and the operation is easy and convenient.

2. The resilient trigger device in the button switch can be self-locking to the pressed state of the button. The lock control rod of the present invention can be self-locking to the unlocking state of the two pins. The prior art uses two spring switch lock buckles for being self-locking to the unlocking state of the pins. The function of the present invention is more reliable.

3. The button switch of the present invention comprises a button seat, a spring, a lock control rod, a button and a hinge pipe which can be mounted quickly. The structure of the present invention is simple and can be mounted conveniently and quickly.

DETAILED DESCRIPTION OF THE PREFERRED EMBODIMENTS

Embodiments of the present invention will now be described, by way of example only, with reference to the accompanying drawings.

Figure 1:
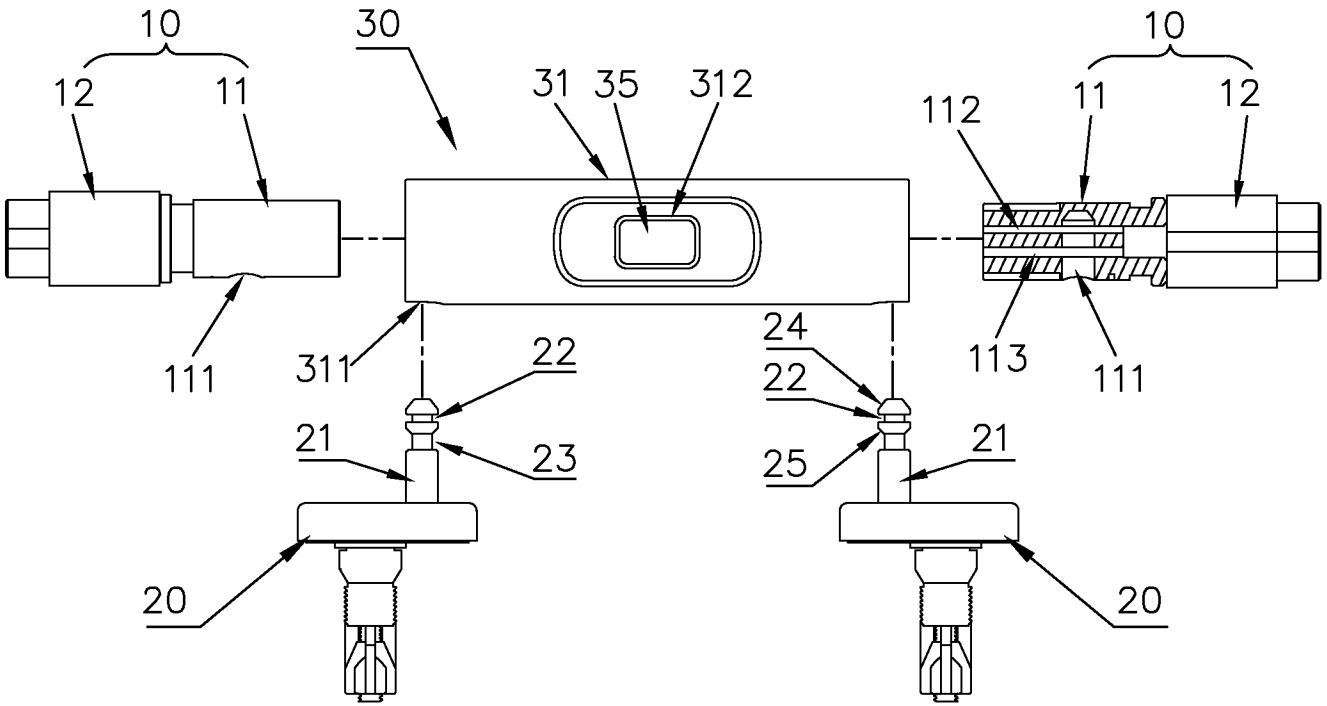
FIG. 1 is an exploded view of the present invention.

As shown in FIG. 1, the present invention discloses a quick installation hinge seat of a closestool cover plate. The present invention comprises two hinge shafts 10, two support seats 20 each with a pin 21, and a button switch 30. Each hinge shaft 10 comprises an anti-rotation shaft 11 and a rotation damper 12 which are coaxially connected. The anti-rotation shaft 11 has a radial pin hole 111 therein. One end of the anti-rotation shaft 11 has an upper slide groove 112 and a lower slide groove 113. The upper slide groove 112 and the lower slide groove 113 are spaced and communicate with the pin hole 111. The vertical pin 21 of each support seat 20 has a locking groove 22 and an unlocking groove 23 which are spaced and annular. The top end of the pin 21 has an annular upper guide ramp 24. The upper wall of the unlocking groove 23 under the locking groove 22 has an annular lower guide ramp 25. When the pin 21 is inserted into the pin hole 111, the upper slide groove 112 is aligned with the locking groove 22 and the lower slide groove 113 is aligned with the unlocking groove 23.

Figure 2:
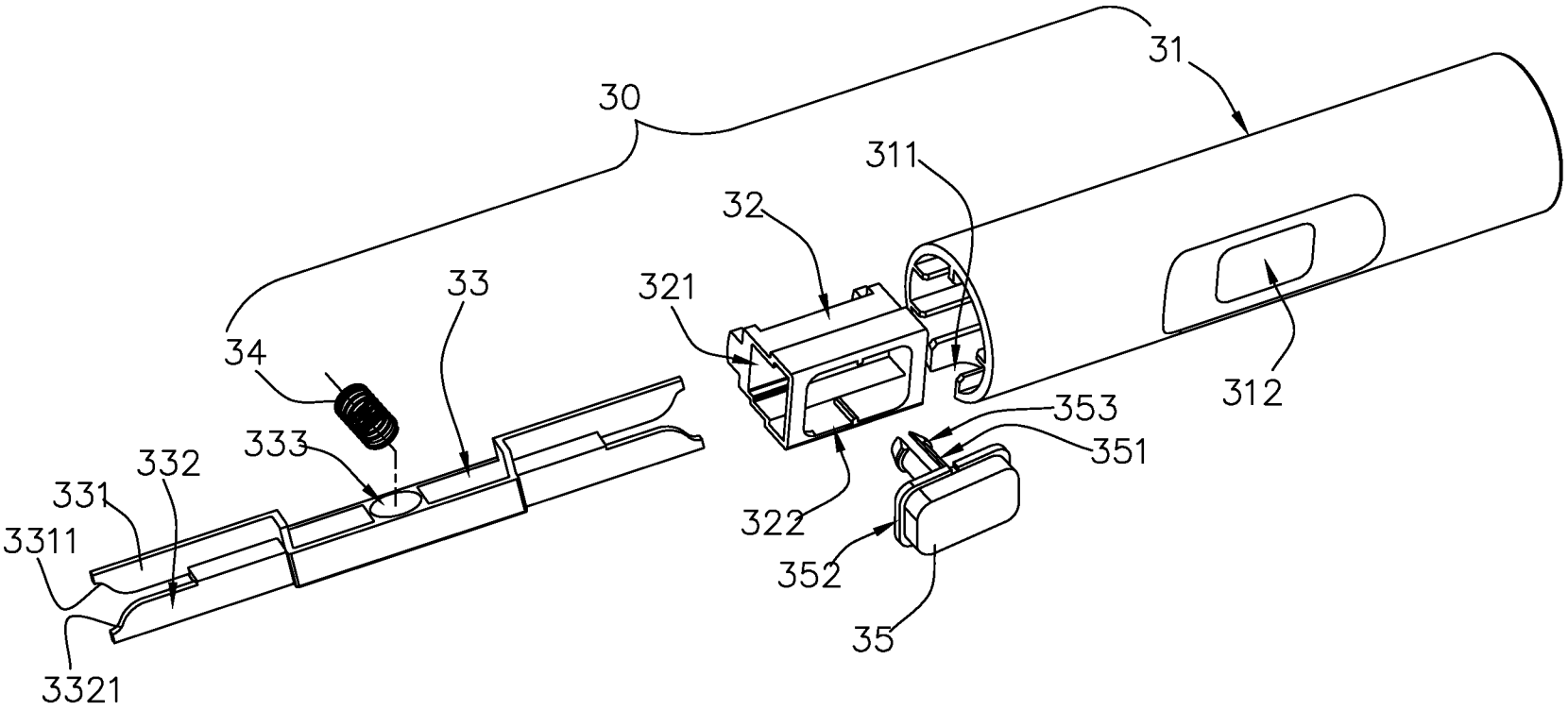
FIG. 2 is an exploded view of the button switch of the present invention.

As shown in FIG. 2, the button switch 30 of the present invention comprises a hinge pipe 31, a button seat 32, a lock control rod 33, a spring 34 and a button 35. The hinge pipe 31 has two openings 311 at the bottoms of two ends thereof. The two openings 311 communicate with the pipe chamber of the hinge pipe 31. The hinge pipe 31 has a button installation hole 312 at a central portion thereof. The button seat 32 has an axial installation hole 321 for insertion and slide of the lock control rod 33. The button seat 32 further has a radial installation hole 322 communicating with the axial installation hole 321 for slide of the button 35 to press the lock control rod 33. The lock control rod 33 has two ends each having a locking plate 331 and an unlocking piece 332. The locking plate 331 and the unlocking piece 332 are arranged in a staggered manner. The locking plate 331 has a first curved edge 3311 at a distal end thereof. The unlocking plate 332 has a second curved edge 3321 at a distal end thereof opposite the first cured edge 3311. The first cured edge 3311 and the second curved edge 3321 each are a quarter-circular arc. The lock control rod 33 has a spring installation hole 333 at a central portion thereof. The button 35 comprises a guide rod which is composed of two resilient plates 351 and deformable radially. Each resilient plate 351 has a conical barb portion 353 at a distal end thereof. The button seat 32 has a circular hole 323 for resilient connection of the guide rod. The button 35 has a flange 352 to mate with slide of the button seat 32. The guide rod and the circular hole 323 constitute a resilient trigger device. To assemble the button switch 30, the spring 34 is first mounted in the central spring installation hole 333 of the lock control rod 33 and the spring 34 is located at the inner rear wall of the button seat 32, and then the lock control rod 33 is axially inserted in the axial installation hole 321 of the button seat 32. The spring 34 is located at the middle of the button seat 32. The button 35 is mounted in the radial installation hole 322 of the button seat 32, and then the button 35 is pressed to bring the control lock rod 33 to compress the spring 34 so that the lock control rod 33, the button seat 32 and the button 35 are axially mounted in the hinge pipe 31. When the button 35 is aligned with the central button installation hole 312 of the hinge pipe 31, the button 35 biased by the spring 34 can be pressed to be in or out of the button installation hole 312. The flange 352 of the button 35 is located in the hinge pipe 31 to engage with the edge of the button installation hole 312. The button 35 is exposed out of the hinge pipe 31. The quick assembly of the button switch 30 of the present invention is completed.

Figure 3:
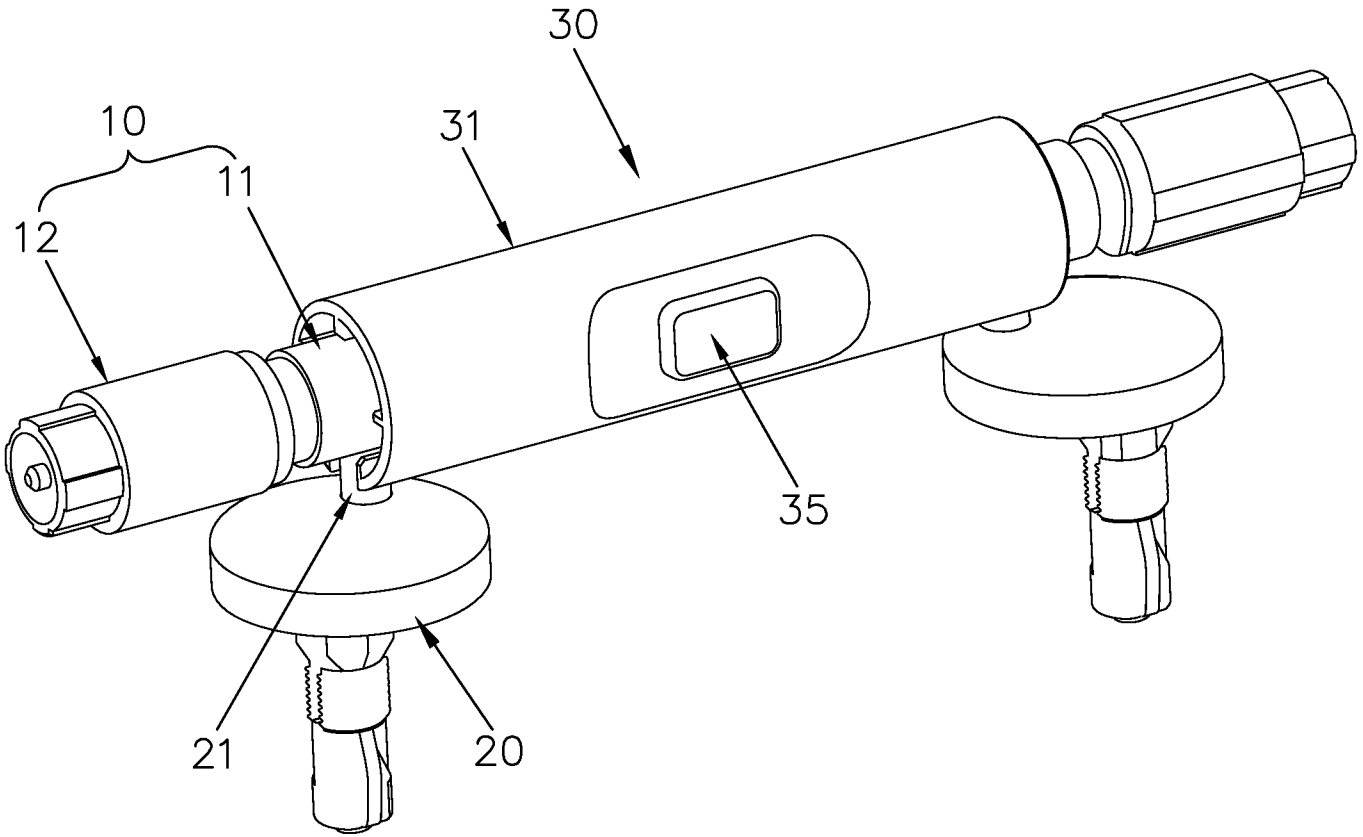
FIG. 3 is a perspective view of the present invention.
Figure 4:
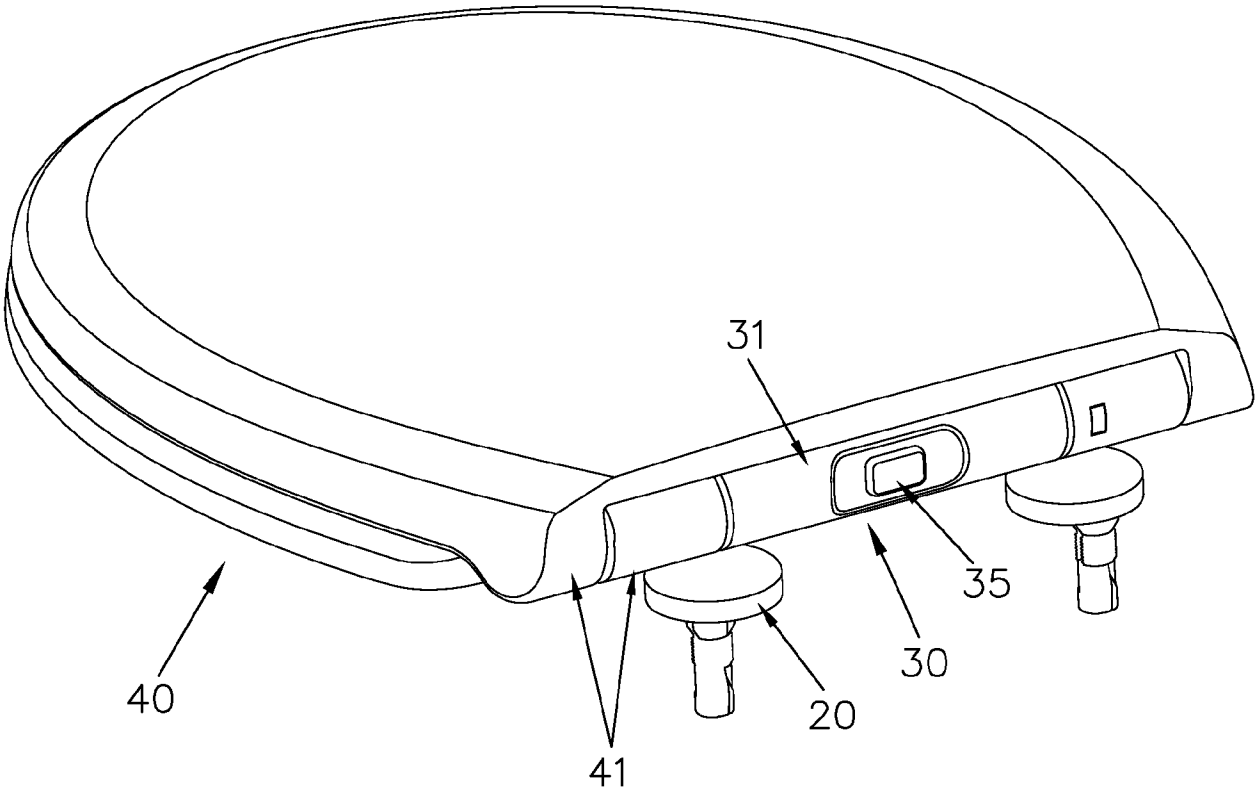
FIG. 4 is a perspective view of the present invention connected with the cover plate.
Figure 5:
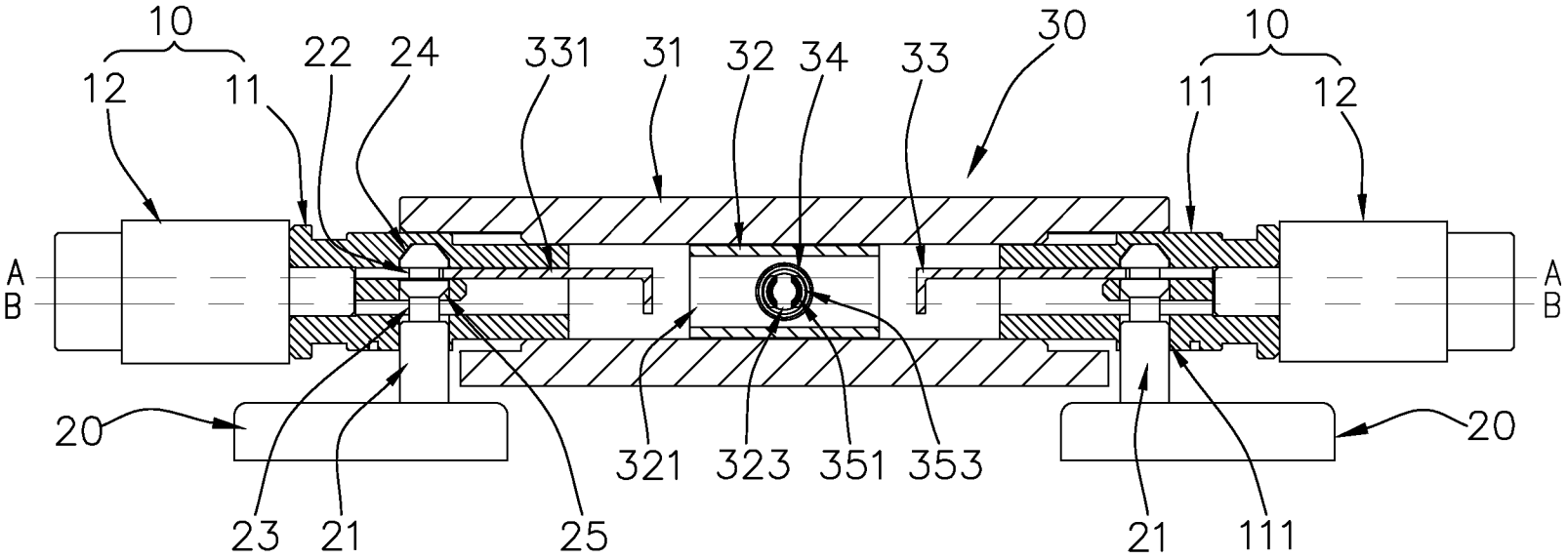
FIG. 5 is a sectional view of the present invention in a locking state.
Figure 13:
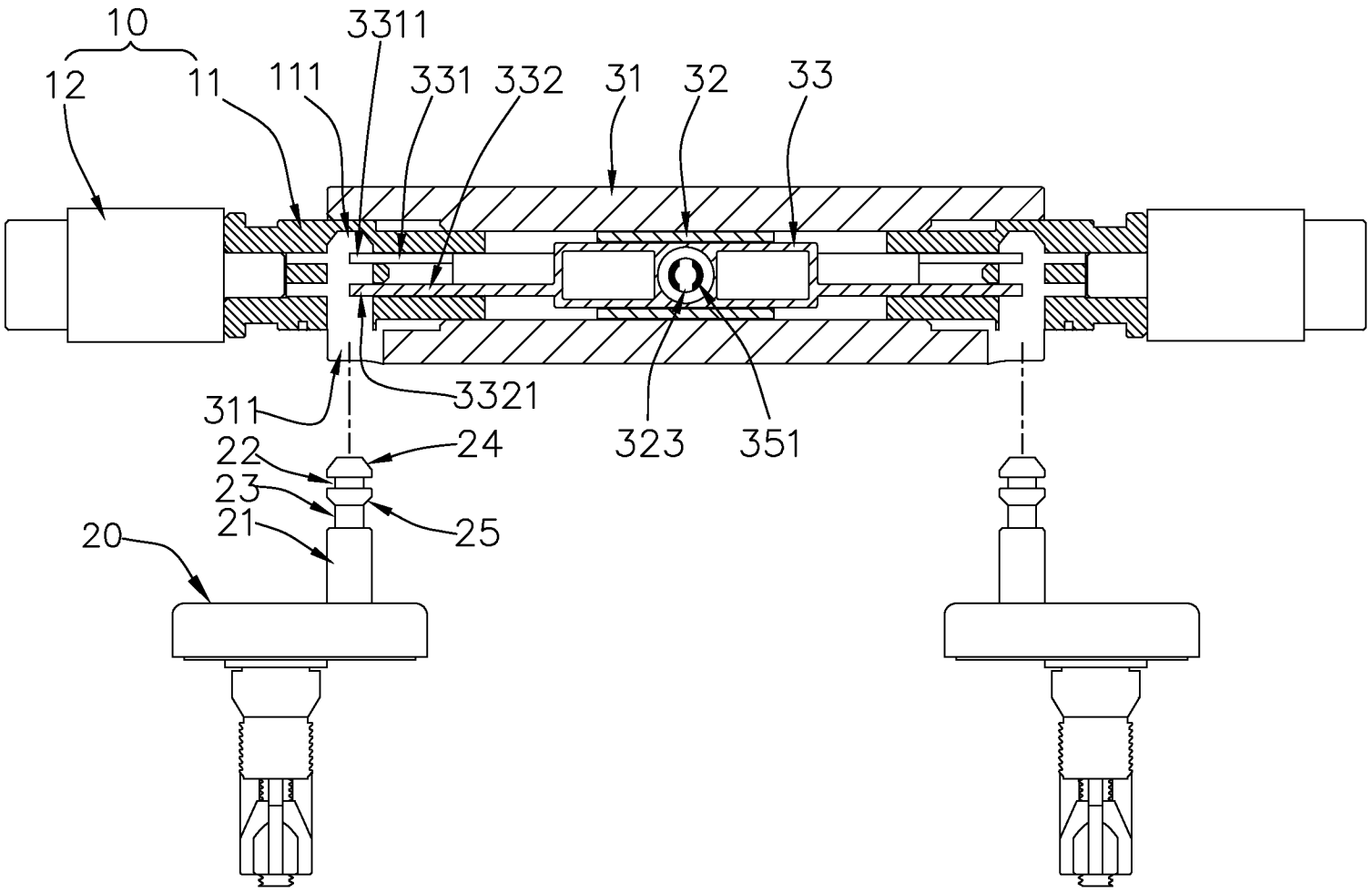
FIG. 13 is a sectional view of the present invention in a disengagement state.

As shown in FIG. 1, FIG. 13, FIG. 3, the two hinge shafts 10 are inserted to the two ends of the of the button switch 30, and the pin holes 111 of the anti-rotation shafts 11 of the two hinge shafts 10 are aligned with the openings 311 of the hinge pipe 31. The rotation dampers 12 are exposed out of the hinge pipe 31. The locking plate 331 of the lock control rod 33 is inserted in the upper slide groove 112 of the anti-rotation shaft 11. The unlocking plate 332 of the lock control rod 33 is inserted in the lower slide groove 113 of the anti-rotation shaft 11. The first curved edge 3311 at the distal end of the locking plate 331 and the second curved edge 3321 at the distal end of the unlocking plate 332 are staggered from each other. As shown in FIG. 3 and FIG. 4, shaft sleeves 41 at two sides of the rear end of a closestool cover plate 40 are connected with the two hinge shafts 10. The shaft sleeves 41 of the cover plate 40 are rotatable relative to the hinge shafts 10. The assembly of the button switch 30 of the present invention and the closestool cover plate 40 is completed.

The working principle and operation of the present invention are described below.

As shown in FIG. 13 and FIG. 4, the pin 21 of the support seat 20 passes the opening 311 of the hinge pipe 31 to be inserted into the radial pin hole 111 of the anti-rotation shaft 11. During insertion, as shown in FIG. 5 to FIG. 8, the upper guide ramp 24 at the top end of the pin 21 holds against the first curved edge 3311 at the distal end of the locking plate 331 for the locking plate 331 in the upper slide groove 112 of the anti-rotation shaft 11 to slide rearward in the radial direction of the anti-rotation shaft 11. The locking plate 331 slides out of the pin hole 111. The lock control rod 33 compresses the spring 34 of the button seat 32. The button 35 and the barb portion 353 of the guide rod composed of the two resilient plates 351 are not engaged with the circular hole 323 of the rear wall of the button seat 32. When the locking groove 22 of the pin 21 is aligned with the upper slide groove 22, the pin 21 is fully inserted into the pin hole 111. The lock control rod 33 is biased by the spring 34 to slide forward in the axial installation hole 321 of the button seat 32 in the radial direction of the hinge pipe 31. Meanwhile, the locking plate 331 in the upper slide groove 112 slides forward. The first curved edge 3311 at the distal end of the locking plate 331 slides into the pin hole 111 and engages with the locking groove 22 of the pin 21 so that the pin 21 cannot be pulled out of the pin hole 111. At the same time, the unlocking plate 332 slides forward in the lower slide groove 113 to slide out of the pin hole 111. The unlocking plate 332 disengages from the unlocking groove 23 of the pin 21. In this way, the hinge shafts 10 at the two sides of the rear end of the cover plate and the support seats 20 are connected quickly so that the cover plate 40 and the closestool are mounted and connected quickly.

Figure 9:
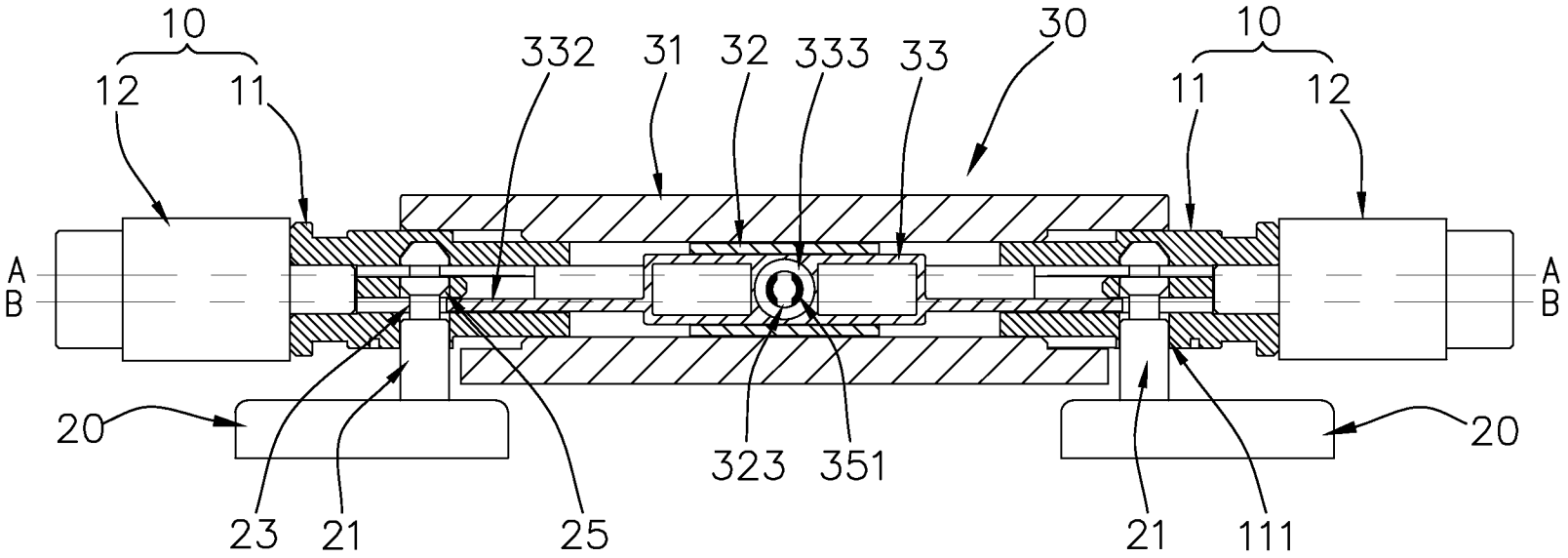
FIG. 9 is a sectional view of the present invention in an unlocking state.
Figure 10:
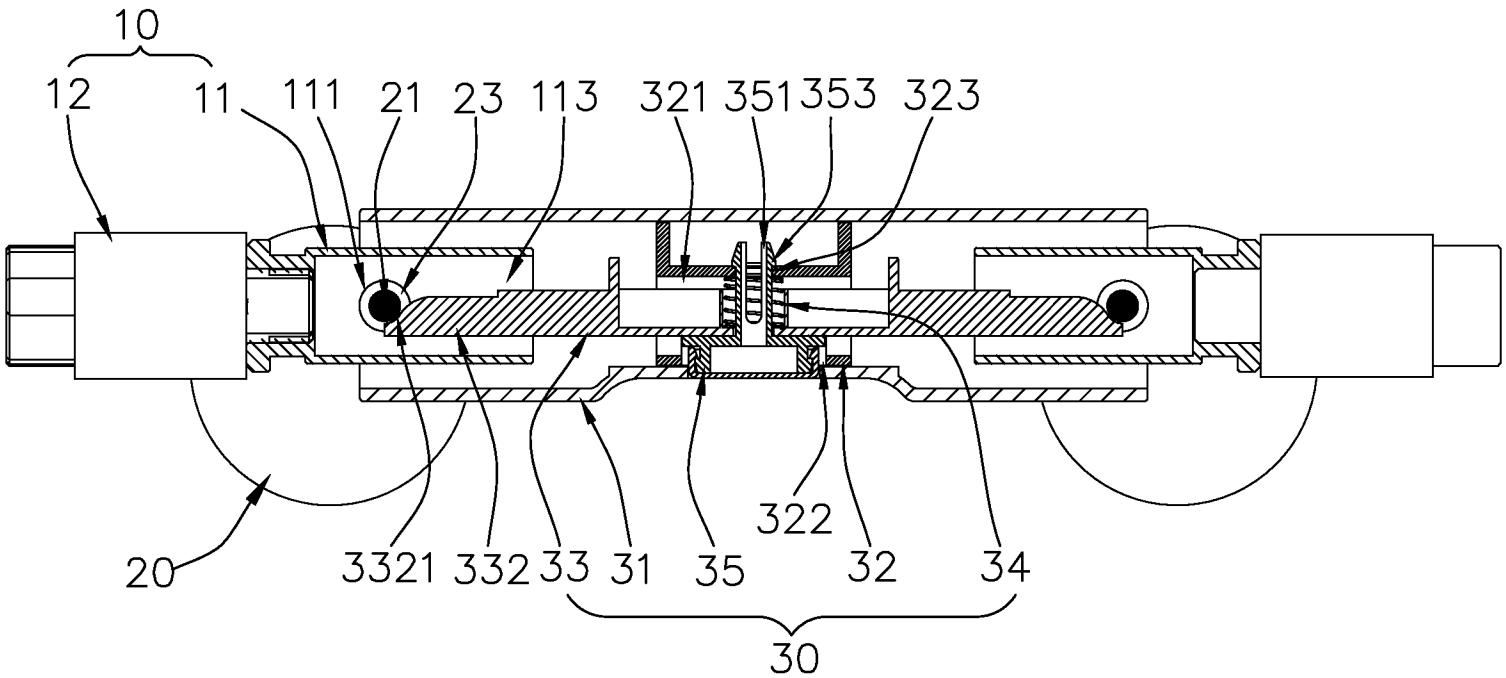
FIG. 10 is a sectional view taken along line B-B of FIG. 9 (the unlocking plate enters the pin hole to engage with the unlocking groove of the pin)
Figure 11:
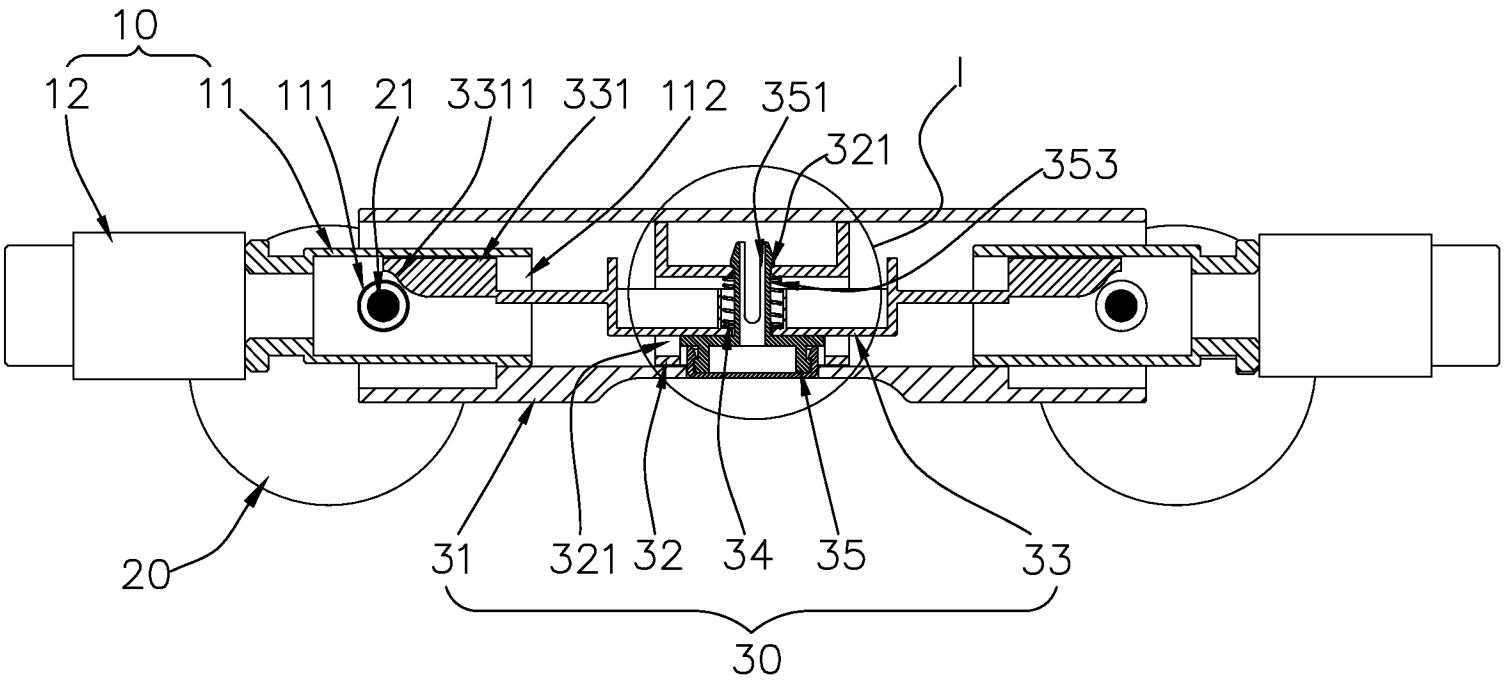
FIG. 11 is a sectional view taken along line A-A of FIG. 9 (the locking plate is out of the pin hole to disengage from the locking groove of the pin)
Figure 12:
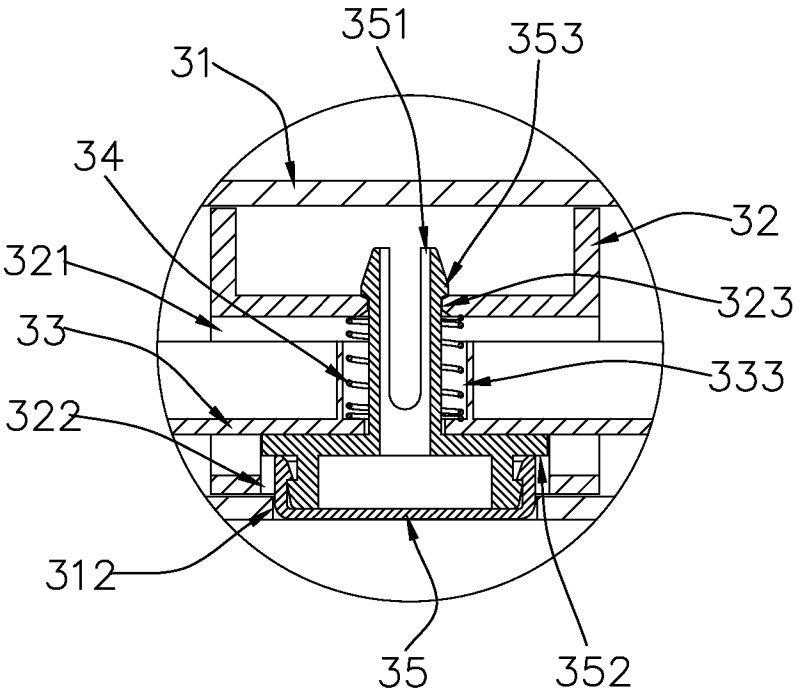
FIG. 12 is an enlarged view of circle I of FIG. 11 (the button is in a self-locking state)

As shown in FIG. 4, FIG. 11 and FIG. 12, when it is necessary to disengage the cover plate 40 from the support seats 20, the button 35 at the middle of the hinge pipe 31 of the button switch 30 is pressed. The button 35 presses the lock control rod 33 to slide rearward in the axial installation hole 321 of the button seat 32 in the radial direction the hinge pipe 31. The spring 34 is compressed by the lock control rod 33. The first curved edges 3311 at the distal ends of the locking plates 331 at the two ends of the lock control rod 33 slide rearward in the upper slide grooves 112 to slide out of the pin holes 11 of the anti-rotation shafts 11 so that the first curved edges 3311 disengage from the locking grooves 22 of the pins 21. At the same time, as shown in FIG. 10, the unlocking plate 332 slides rearward in the lower slide groove 113, and the second curved edge 3321 at the distal end of the unlocking plate 332 slides into the pin hole 111 to engage with the unlocking groove 23 of the pin 21. As shown in FIG. 10 to FIG. 12, the guide rod composed of the two resilient plates 351 at the center of the button 35 passes the circular hole 323 of the rear wall of the button seat 32. The barb portions 353 at the distal ends of the two resilient plates 351 engage with the end surface of the circular hole 323 after passing the circular hole 323 so that the button 35 is self-locking on the lock seat 32. As shown in FIG. 9, the unlocking state of the locking plates 331 at the two ends of the lock control rod 33 relative to the pins 21 can be kept so that the pins 21 can disengage from the pin holes. As shown in FIG. 4 and FIG. 13, the cover plate 40 is pulled upward, the pins 21 are out of the pin holes 111 of the anti-rotation shafts 11 in the shaft sleeves of the cover plate 40 so that the cover plate 40 disengages from the support seats 20 quickly.

Figure 6:
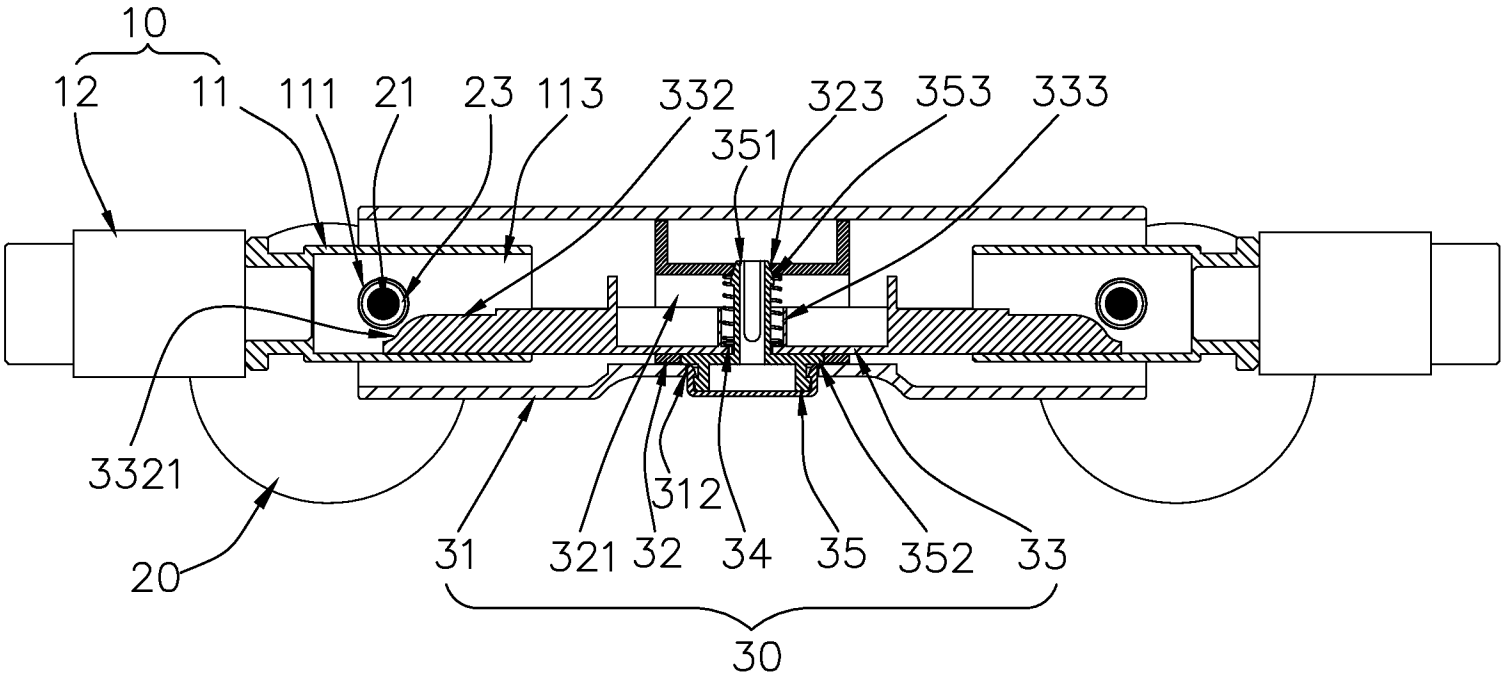
FIG. 6 is a sectional view taken along line B-B of FIG. 5 (the unlocking plate is out of the pin hole to disengage from the unlocking groove of the pin)
Figure 7:
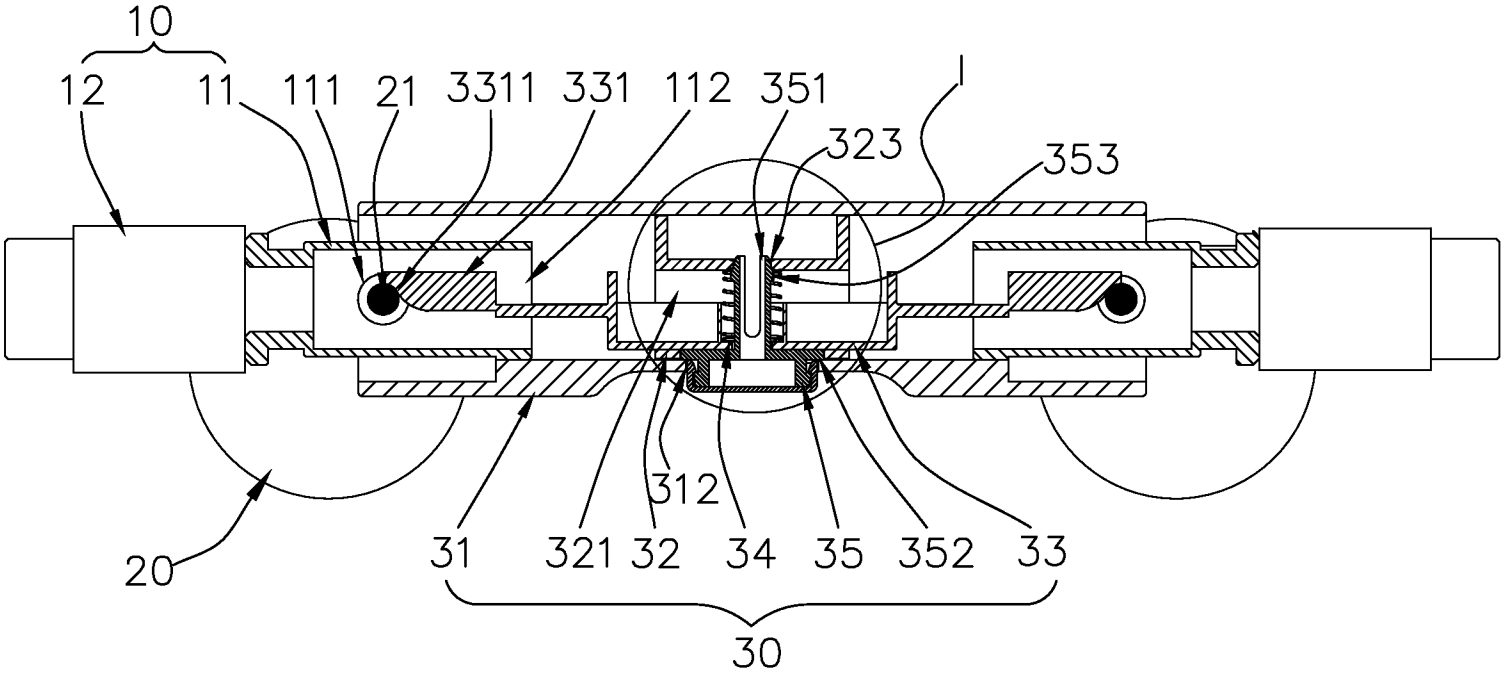
FIG. 7 is a sectional view taken along line A-A of FIG. 5 (the locking plate enters the pin hole to engage with the locking groove of the pin)
Figure 8:
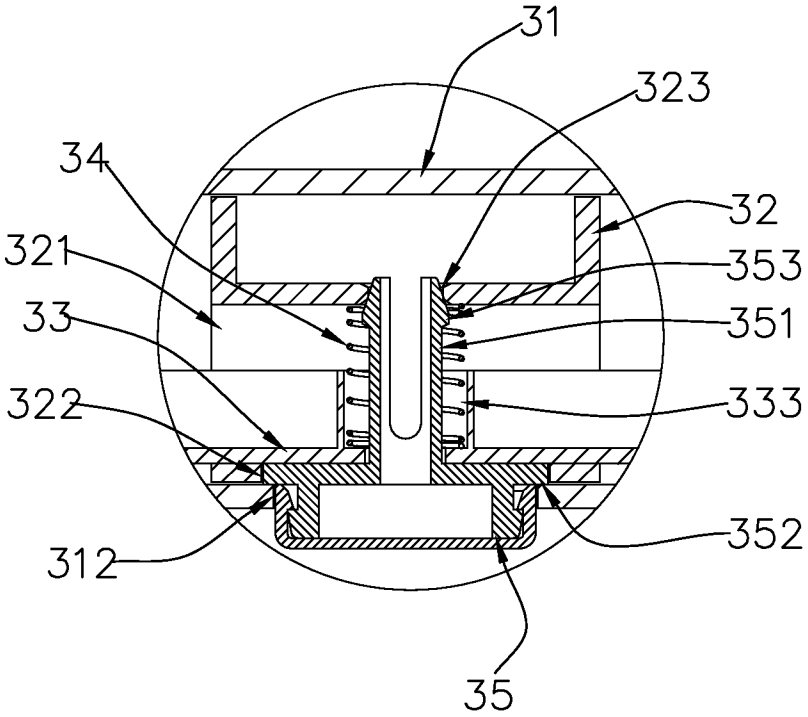
FIG. 8 is an enlarged view of circle I of FIG. 7 (the button is in a free state)

As shown in FIG. 10 and FIG. 6, when the pin 21 is pulled out of the pin hole 111, the lower guide ramp 25 in the unlocking groove 23 pushes the second curved edge 3321 at the distal end of the unlocking plate 332 downward to push the second curved edge 3321 out of the pin hole 11. During the process, the unlocking plate 332 brings the lock control rod 33 to move forward. The lock control rod 33 enforces the button 35 to move forward to disengage the barb portions 353 at the distal ends of the two resilient plates 351 from the circular hole 323 of the button seat 32. The lock control rod 33 and the button 35 are returned to the initial state by the spring 34, and the barb portions 353 are returned into the circular hole 323.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick installation hinge seat of a closestool cover plate, comprising two hinge shafts to be mounted in shaft sleeves at two sides of a rear end of the cover plate, two support seats for connecting with a closetool, the hinge shafts each having a radial pin hole for connection of a pin provided on each of the support seats, a button switch mounted between the two hinge shafts to control the pin to be in or out of the pin hole; the button switch comprising a hinge pipe having two ends connected to the two hinge shafts, a button seat secured in a middle portion of the hinge pipe, a lock control rod which is axially inserted in the button seat and slidable in the button seat in a radial direction of the hinge pipe, a spring disposed between the button seat and the lock control rod, and a button mounted on the button seat and holding against the lock control rod; the button being exposed out of a button installation hole at the middle portion of the hinge pipe, two ends of the lock control rod being axially inserted in the two hinge shafts respectively and slideable radially, each of the two ends of the lock control rod having a locking plate and an unlocking plate, the locking plate and the unlocking plate being arranged in a stagger manner, the pin having an annular locking groove and an annular unlocking groove thereon, the locking plate being adapted to engage with the locking groove, the unlocking plate being adapted to disengage from the unlocking groove; a resilient trigger device provided between the button seat and the button for the button to be self-locking in a pressed state, wherein when the button is self-locking, the locking plate disengages from the locking groove and the unlocking plate engages with the unlocking groove, wherein the button comprises a guide rod composed of two resilient plates and deformable radially, each resilient plate having a conical barb portion at a distal end thereof, the button seat having a circular hole for resilient connection of the guide rod, the guide rod and the circular hole constituting the resilient trigger device, when the guide rod is inserted in the circular hole and the barb portion engages with an end surface of the circular hole, the resilient trigger device forms a self-locking state relative to the button, when the guide rod disengages from the end surface of the circular hole, the resilient trigger device releases the self-locking state relative to the button and the button is returned.

* * * * *